United States Patent [19]

Lackner

[11] Patent Number: 4,847,944

[45] Date of Patent: Jul. 18, 1989

[54] VACUUM CLEANING WITH POWERED BRUSH ROLL

[75] Inventor: John R. Lackner, North Ridgeville, Ohio

[73] Assignee: The Scott Fetzer Company, Westlake, Ohio

[21] Appl. No.: 252,510

[22] Filed: Sep. 30, 1988

[51] Int. Cl.[4] ..... A47L 9/04

[52] U.S. Cl. ..... 15/392; 15/182

[58] Field of Search ..... 15/179, 182, 183, 391, 15/392

[56] References Cited

U.S. PATENT DOCUMENTS

| | | | |
|---|---|---|---|
| 2,707,792 | 5/1955 | Waller | 15/392 X |
| 3,325,849 | 6/1967 | Waters | 15/392 |
| 3,846,865 | 11/1974 | Holman | 15/392 |
| 4,403,372 | 9/1983 | Keane et al. | 15/391 X |

*Primary Examiner*—Chris K. Moore

*Attorney, Agent, or Firm*—Pearne, Gordon, McCoy & Granger

[57] ABSTRACT

A vacuum cleaner having a powered brush roll with a one-piece thread guard and mounting portion. The thread guard is a molded thermoplastic element which encloses the adjacent end of the brush roll and the bearing mounted in such adjacent end. The thread guard provides a skirt extending around the adjacent end of the brush roll and is held against rotation with the brush roll by a mounting portion. The mounting portion of the thread guard provides a sound-deadening mounting structure for the brush roll. The skirt is initially sized to frictionally fit the adjacent end of the brush roll and, after initial relative rotation between the skirt and the brush roll, provides a zero clearance fit to prevent string, thread and other debris from entering the bearing zone. During initial operation, the heat softens the thermoplastic material of the skirt, causing it to wear away and deform until frictional contact is eliminated and a free running condition occurs. The frictional contact is eliminated when a zero clearance fit is provided. The brush roll body is wood, which tends to change dimensionally with changes in ambient humidity. If the brush roll body expands slightly during the use of the vacuum cleaner, frictional contact is re-established and the thread guard automatically wears to re-establish a zero clearance free running condition.

14 Claims, 3 Drawing Sheets

VACUUM CLEANING WITH POWERED BRUSH ROLL

BACKGROUND OF THE INVENTION

This invention relates generally to vacuum cleaners, and more particularly to a vacuum cleaner having a powered brush which provides a novel and improved thread guard and to a novel and improved method of producing same.

PRIOR ART

Powered brushes are often journaled in the nozzle of a vacuum cleaner. Such brushes are often provided with a thread or string guard to prevent threads from entering the bearings and interfering with the operation of the bearings. Examples of such brushes with thread guards are illustrated in U.S. Letters Pat. Nos. 1,999,696; 2,176,769; and 4,403,372. Generally, such thread guards include a number of interfitting parts which define an obstacle to the movement of the thread, string or other debris into the bearing which journals the brush.

SUMMARY OF THE INVENTION

The present invention provides a novel and improved vacuum cleaner brush roll and thread guard structure. The brush roll includes bearings at each end which journal the brush on a nonrotating shaft. The shaft is mounted at the ends of the brush roll in a vacuum cleaner nozzle.

A nonrotating thread guard is mounted at at least one end of said brush roll. The thread guard provides a cylindrical skirt that fits around the adjacent end portion of the brush roll with insufficient clearance to allow passage of threads, string, or other debris into the adjacent bearing.

In accordance with the present invention, the skirt is formed of a thermoplastic material initially sized to frictionally contact the end portion of the brush roll. The brush roll is then rotated relative to the cylindrical skirt, causing frictional heating of the skirt material. This causes heat-softening of the skirt material, resulting in wear and distortion of the material of the skirt along the interface between the skirt and the brush roll. This automatically produces a reduction in the frictional contact between the skirt and the end portion of the thread roll. Relative rotation continues until the brush roll turns substantially freely within the skirt.

Such free rotation occurs when the cylindrical skirt ceases to contact the brush roll with sufficient pressure to produce any substantial frictional heating. When this occurs, the thread guard fits the brush roll with substantially zero clearance. Therefore, the thread guard operates effectively to prevent threads, string, or other debris from passing into the adjacent bearing.

In the illustrated embodiment, the brush roll is formed of wood, which is difficult to produce to very close tolerances, and also which tends to expand and shrink to some extent with changes in the ambient humidity. However, with the present invention, a self-correcting structure is provided. If, during the use of the brush roll within the vacuum cleaner, a humidity condition occurs which causes the brush roll to expand slightly, thereby re-establishing frictional contact with the cylindrical skirt of the thread guard, the frictional contact automatically and quickly produces a refitting of the cylindrical skirt to eliminate such frictional contact and the thread guard continues to function properly.

In the illustrated embodiment, the thread guard is formed of polypropylene and is molded to also enclose the mounting portion for the shaft. Therefore, the thread guard also provides a noise-deadening mounting structure for mounting the brush in the vacuum cleaner nozzle.

With this invention, a simple, low-cost, one-piece thread guard is provided which is easily manufactured and installed. After the initial operation, an automatic zero clearance fit is provided without requiring close tolerance manufacture. Further, in the illustrated embodiment, the mounting of the thread guard also provides a noise-reduction mounting for the brush assembly within the vacuum cleaner nozzle.

These and other aspects of this invention are illustrated in the accompanying drawings, and are more fully described in the following specification.

DETAILED DESCRIPTION OF THE DRAWINGS

Figure 1:
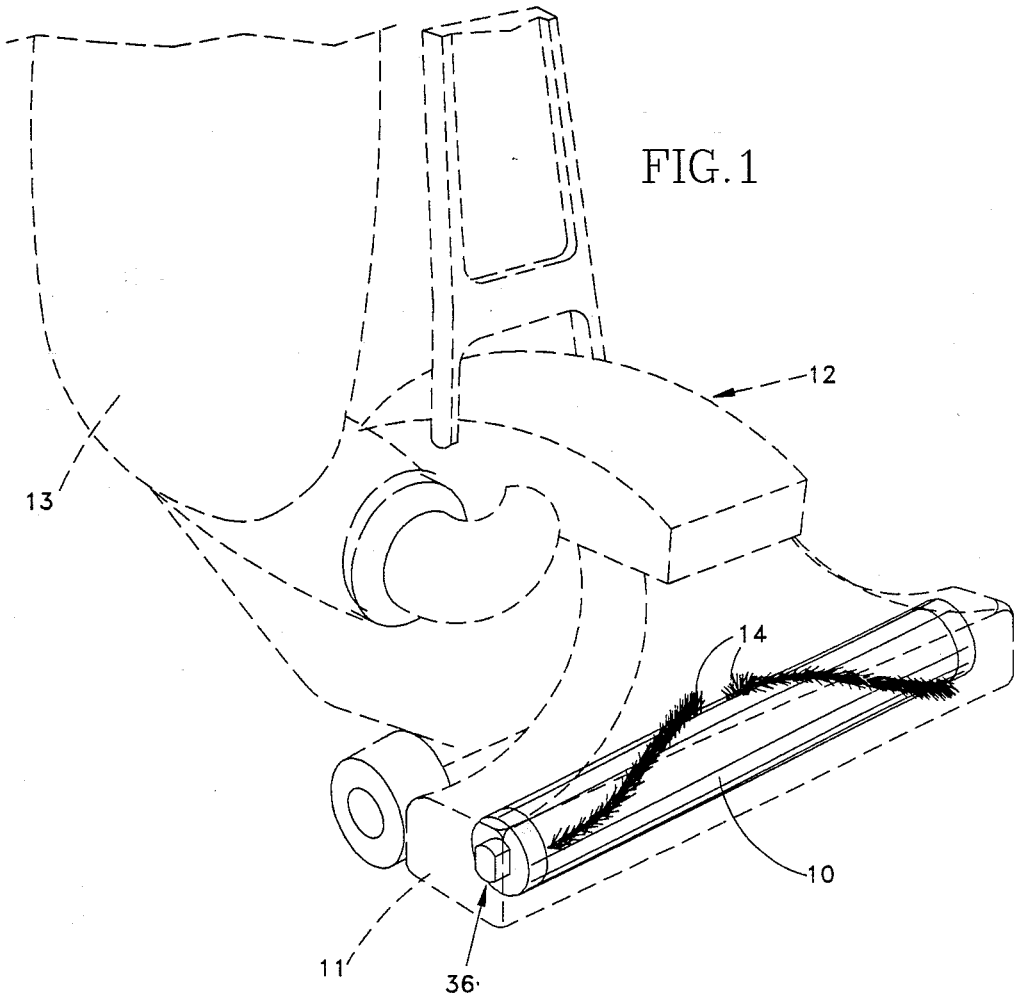
FIG. 1 illustrates a brush roll incorporating the present invention, mounted within the nozzle of a typical upright vacuum cleaner, schematically illustrated in phantom.

FIG. 1 illustrates a powered brush roll 10 mounted at its ends for rotation within the nozzle 11 of an upright vacuum cleaner 12. Such a vacuum cleaner typically is provided with an electric motor-driven fan which draws air into the nozzle 11 and discharges the dirt-laden air into a dust bag 13. Typically, the brush roll 10 is driven by means of a belt wrapped around the central portion of the brush roll and connected to the fan motor. Brushes 14 are mounted along the length of the brush roll 10 and function to agitate the rug or the like being cleaned to loosen the dirt therein so that the dirt can be drawn by the flow of air into the nozzle and deposited in the dust bag 13.

Figure 2:
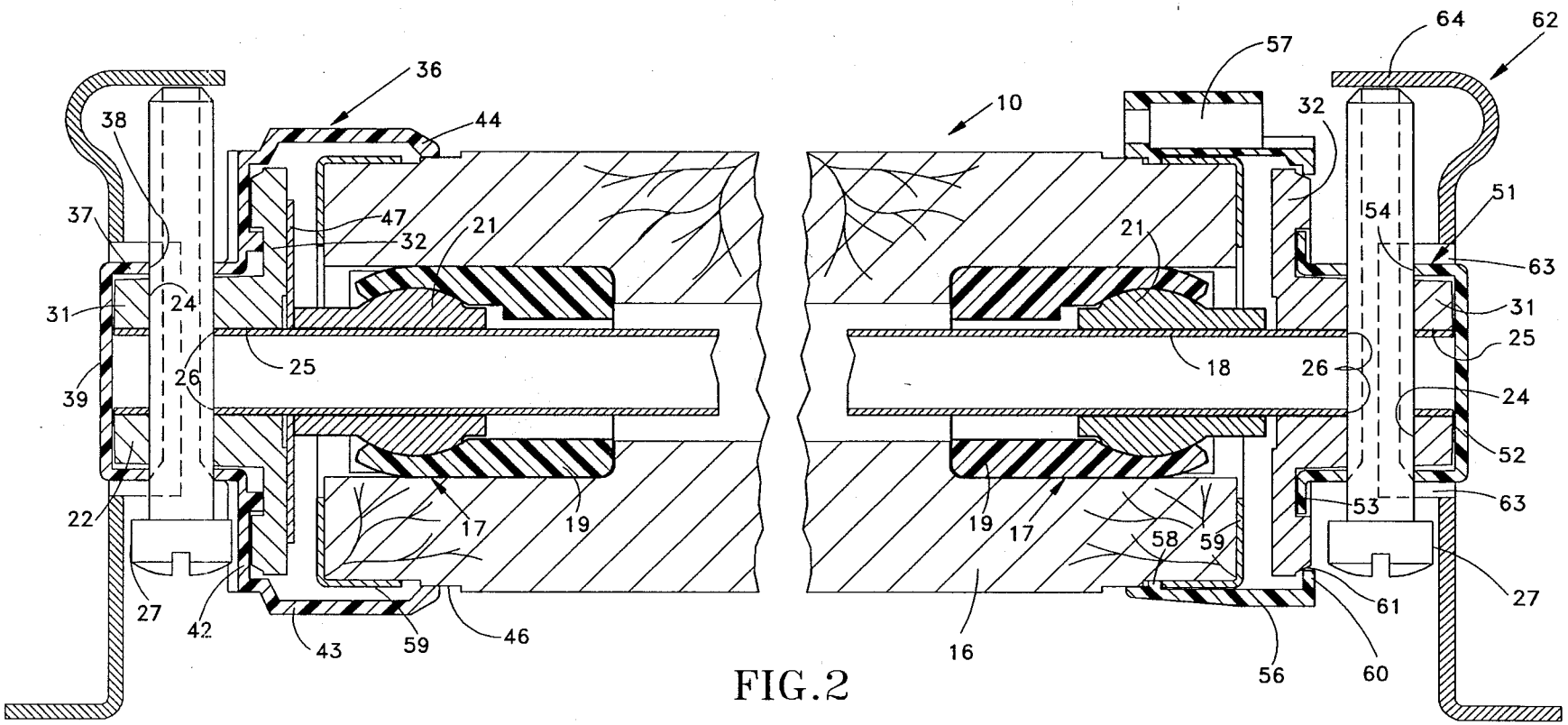
FIG. 2 is an enlarged, broken, longitudinal section illustrating the structural detail of a brush roll incorporating a thread guard in accordance with the present invention.

Referring to FIG. 2, the brush roll 10 includes a tubular body 16, which may be formed of wood. Mounted on each end of the body 16 is a bearing assembly 17 which journals the brush roll on an axially extending shaft 18 for rotation relative to such shaft. In the illustrated embodiment, the two bearing assemblies 17 are identical and oppositely facing. Each bearing assembly 17 includes a plastic sleeve 19 press-fitted into the adjacent end of the brush roll body 16 and a metallic bearing element 21 which engages the exterior of the shaft 18 adjacent to the ends thereof and journals the brush roll 10 for rotation about its longitudinal axis. The sleeve 19 and bearing element 21 are formed with a spherical interface which allows limited pivotal movement of the bearing element relative to the sleeve so that the bearing can automatically align itself with the shaft 18.

This bearing structure is disclosed in greater detail and claimed in copending application Ser. No. 249,377, filed 9-26-88, and such application is incorporated herein by reference in its entirety to provide a full description of the bearing assemblies 17. It should be understood, however, that the present invention is not restricted to the particular bearing structure illustrated, and that other bearing support systems may be utilized.

Mounted on the ends of the shaft 18 and immediately adjacent to the ends of the brush roll 10 are brush roll end caps 22 and 23. The end caps 22 and 23 are each formed with an axial bore 25 to receive the adjacent end of the shaft 18 and a laterally extending, threaded bore 24 aligned with openings 26 in the shaft 18. A threaded bolt 27 extends through the associated bore 24 and the opening 26.

The end caps 22 and 23 are identical in structure and include a mounting portion 31 and a radially extending flange portion 32 at the end of the mounting portion 31 and adjacent to the end of the brush roll body 16. The exterior of the mounting portion 31 of the end caps 22 and 23 provides a non-circular periphery having opposed flats 34, best illustrated in FIG. 3, which extend parallel to the threaded bore 24 on opposite sides thereof.

Figure 3:
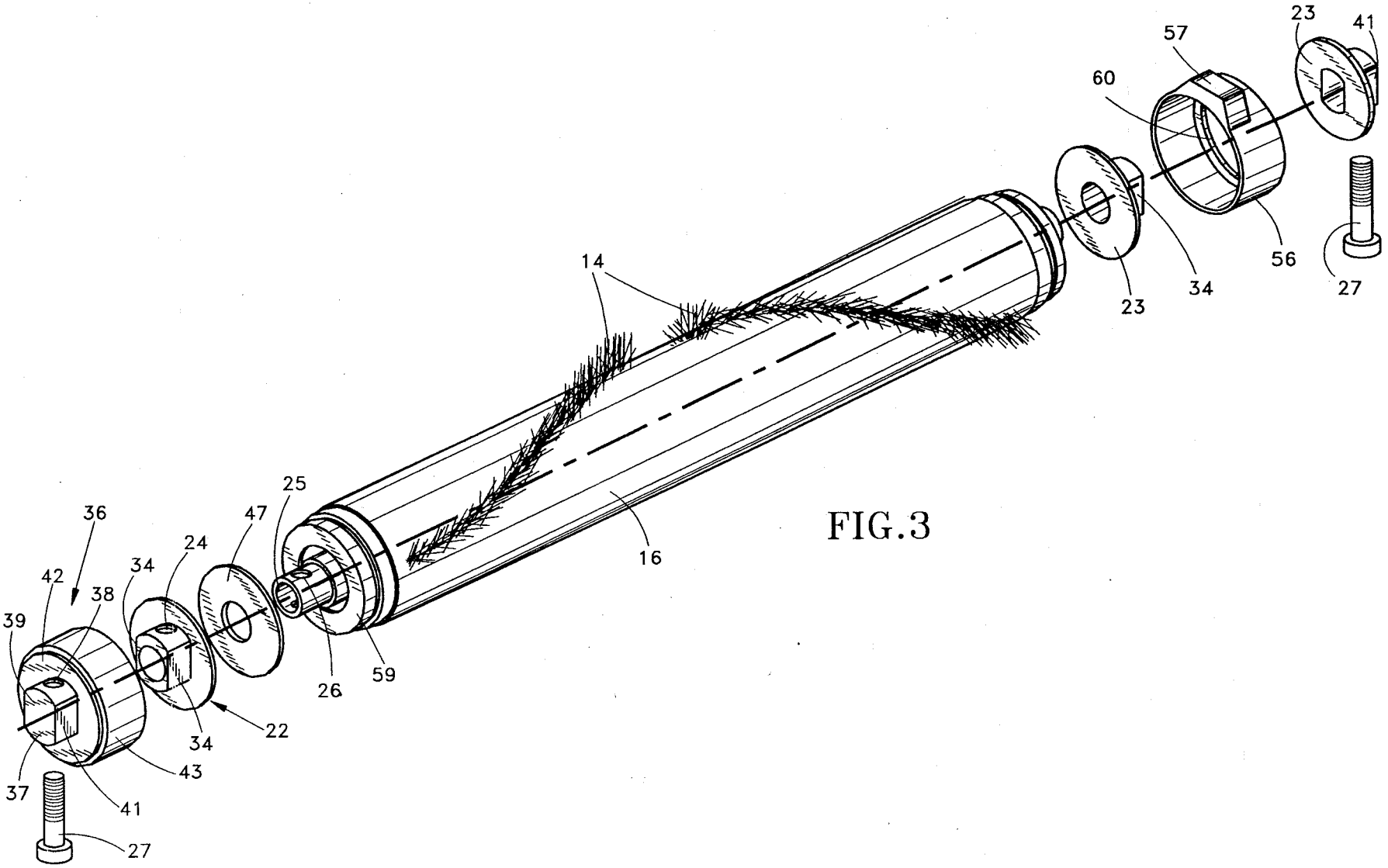
FIG. 3 is an exploded perspective view of the elements of the brush roll assembly.

Positioned around the end cap 22 is a one-piece, molded plastic thread guard and mounting element 36. The thread guard 36 provides a cup-shaped mounting portion 37 sized and shaped to closely fit the mounting portions 31 of the end cap 22 and also providing lateral openings 38 through which the associated bolt 27 extends. The mounting portion 37 of the thread guide 36 provides an end wall 39 which encloses the end of the shaft 18 and the end of the associated end cap 22. As best illustrated in FIG. 3, the thread guard also provides opposed flats 41 which closely fit the flats 34 of the end cap 22.

Extending from the inner end of the mounting portion 38 of the thread guide 36 is a radially extending wall 42 which connects the end portion 37 to a cylindrical skirt 43. The cylindrical skirt 43 extends axially along the periphery of the brush roll body 16 and is provided with an inturned end 44 which embraces a peripheral portion 46 of the brush roll body 16. The inturned end provides essentially a zero clearance fit with the peripheral portion 46, as discussed in greater detail below, and prevents the migration of threads, string, and other debris into the adjacent end of the brush roll, thereby preventing such material from damaging the associated bearing assembly 17.

The thread guard 36 is held against rotation relative to the shaft 18 and the end cap 22 by the associated bolt 27 and the interfitting flats 34 and 41, respectively formed on the end cap 22 and the thread guard 36. Therefore, the brush roll body 16 rotates within the inturned end 44 of the thread guard 36.

Positioned between the end of the bearing element 21 and the end cap 22 is a thrust washer 47 which axially locates the brush roll relative to the end cap 22 and, in turn, relative to the shaft 18. The belt (not illustrated) which connects the brush roll to the fan motor of the vacuum cleaner produces an axial bias on the brush roll during the operation of the vacuum cleaner, which maintains the end of the bearing element 21 against the thrust washer 47, so as corresponding thrust washer is not required at the opposite end of the brush roll.

In the illustrated embodiment, the thread guard structure at the end cap 23 differs from the thread guard structure at the end cap 22. Positioned over the mounting portion 31 of the end cap 33 is a molded plastic cup 51 shaped to closely fit the mounting portion 31 and providing an end wall 52 enclosing the end of the mounting portion 31 and the adjacent end of the shaft 18. The inner end of the cup 51 provides a radially extending flange 53 fitting against the adjacent wall of the radial flange 32 of the end cap 23. Here again, the cup 51 provides openings 54 through which the bolt 27 extends.

The thread guard at this end of the thread roll is provided by a cylindrical molded plastic thread guard ring 56 which extends over the adjacent end of the brush roll body with a sufficiently tight fit to ensure co-rotation between the thread guard ring 56 and the brush roll body 16. Mounted on the thread guard 56 is a magnet 457 which constitutes part of a system for indicating brush rotation. Such magnet 57 rotates with the brush and is positioned to closely pass a small coil mounted in the nozzle 11 of the vacuum cleaner to generate an electrical signal applied to an indicator light when the brush roll rotates.

The thread guard 56 is provided with an internal rib 58 positioned within a groove defined in part by a metal clamp ring 59 mounted on the end of the brush roll body 16. A clamp ring 49 is provided at each end of the body 16 to prevent splitting of the body 16 of the brush roll and, in cooperation with the internal rib, ensures that the thread guard remains in place.

The outer end of the thread guard 56 is formed with an inturned shoulder 60 which extends into close proximity with an inwardly inclined wall portion 61 on the periphery of the flanged portion 32 of the end cap 23. The inturned shoulder 60, in combination with the inwardly inclined wall portion 61, functions to prevent threads, string, and other debris from entering into the adjacent bearing area.

The brush roll assembly in its entirety is mounted within the nozzle of the vacuum cleaner by means of a bracket 62 provided in the nozzle at each end of the brush roll. The bracket includes parallel flanges 63 which engage the opposite sides of the thread guard 36 and the cup 51 along the flat 41 thereof to laterally position the ends of the brush roll and to prevent rotation of the shaft 18. The vertical position of the brush roll within the nozzle is adjustably determined by the two bolts 27 which engage at their ends a lateral projection 64 on each of the associated brackets 62. These bolts permit the vertical adjustment of the brush roll to compensate for brush wear and to ensure that the brush roll is properly positioned within the nozzle for optimum performance.

The thread guard 36 is formed of a thermo-plastic material, preferably polypropylene, and is initially formed so that the inturned end 44 fits the peripheral portion 46 with a slight interference or slip fit. When the brush roll is initially rotated, friction exists between the brush roll body 16 and the inturned end 44, causing heat, which softens the material of the inturned end and causes the surface material thereof to abrade or wear away slightly and also distort from its original size a small amount. Such wear and distortion continue while the frictional contact is sufficient to create heating in the inturned end 41.

After a short period of time of operation, a condition automatically occurs in which the frictional contact ceases to exist, resulting in cooling of the material of the inturned end. This occurs when an essentially zero clearance fit exists between the inner wall of the inturned end and the peripheral portion 46 of the brush roll. Because the brush roll body 16 is not thermoplastic, it does not wear away and the automatic fitting of the thread guard results from the heat softening of the thread guard.

In order to assure that such zero clearance fit occurs uniformly, the peripheral portion 46 is formed to be concentric with the axis of rotation of the brush roll. In the illustrated embodiment, a shallow cut is performed on the brush roll body 16 to assure concentricity between the portion 46 and the axis of rotation of the brush roll.

The thread guard 36 provides a noise-damping mounting of the brush roll within the bracket 62, as well as an effective thread guard with a single molded plastic part.

In the illustrated embodiment, a more elaborate two-piece structure is provided at the opposite end of the brush roll in order to accommodate the magnet 57. It should be understood, however, that in installations in which the magnet is not required to provide an indicating signal of brush rotation, a thread guard identical with the thread guard 36 can be installed on both ends of the brush roll, thereby reducing the number of elements required to provide the mounting and thread guard functions.

When the brush roll body is formed of wood, there is a tendency for the dimensions of the thread roll body 16 to change slightly with changes in the ambient or environmental humidity. In the event that the thread roll body expands slightly, again establishing a friction fit with the thread guard 36, the heating that results from such friction produces further distortion and wear of the thread guard until a zero clearance fit is re-established. Therefore, a reliable thread guard having a minimum amount of clearance is provided during the life of the brush roll.

Although the preferred embodiment of this invention has been shown and described, it should be understood that various modifications and rearrangements of the parts may be resorted to without departing from the scope of the invention as disclosed and claim herein.

What is claimed is:

1. A vacuum cleaner comprising a nozzle through which dirt-laden air passes, a generally cylindrical powered brush roll, a shaft extending from each end of said brush roll, bearings at each end of said brush roll journaling said brush roll on said shaft for rotation relative thereto, end brackets in said nozzle supporting the ends of said shaft within said nozzle and preventing rotation of said shaft when said brush roll rotates relative to said shaft, a thread guard at at least one end of said brush roll mounted in the associated of said brackets and providing a noise-deadening mounting of said one end of said brush roll in said associated bracket, said thread guard providing a skirt extending along said one end of said brush roll, said skirt mating with said one end of said brush roll with substantially zero clearance and preventing threads and other debris from passing into the adjacent bearing, said skirt being formed of a thermoplastic material initially sized to engage one end of said brush roll and which wears and deforms under heat generated by friction when said brush roll rotates until frictional contact with said brush roll is substantially eliminated and said brush roll rotates substantially freely within said thread guard, said cylindrical skirt being sized to fit said end portion with insufficient clearance to allow threads and debris from passing into the adjacent bearing after said frictional contact with said brush roll is substantially eliminated.

2. A vacuum cleaner as set forth in claim 1, wherein said brush roll is formed of a non-thermo-plastic material.

3. A vacuum cleaner as set forth in claim 2, wherein said brush roll is formed of wood which changes dimensionally slightly in response to changes in environmental humidity.

4. A powered vacuum cleaner brush roll comprising a shaft for mounting in the nozzle of a vacuum cleaner, a brush roll, bearings at each end of said brush roll journaling said brush roll on said shaft for rotation relative thereto, said brush roll providing an end portion substantially concentric with said shaft, and a thread guard at at least one end of said brush roll fixed against rotation relative to said shaft, said thread guard providing a skirt extending along said end portion of said brush roll, said skirt mating with said end portion with substantially zero clearance and preventing threads and other debris from passing into said adjacent bearing, said skirt being formed of a thermoplastic material initially sized to engage said end portion and which wears and deforms under heat generated by friction when said brush roll rotates until frictional contact with said brush roll is substantially eliminated, said cylindrical skirt being sized to fit said end portion with insufficient clearance to allow threads and debris from passing into said adjacent bearing after said frictional contact with said brush roll is substantially eliminated.

5. A powered vacuum cleaner brush roll as set forth in claim 4, wherein said end portion is provided by material which is non-thermoplastic.

6. A powered vacuum cleaner brush roll as set forth in claim 5, wherein said thread roll is formed of wood.

7. A powered vacuum cleaner brush roll as set forth in claim 4, wherein said thread guard includes a cup-shaped mounting portion enclosing the entirety of said one end of said brush roll and providing a noise-reducing mounting thereof.

8. A powered vacuum cleaner brush roll as set forth in claim 7, wherein an end cap is mounted on the end of said shaft at said one end of said brush roll, said thread guard enclosing said end cap.

9. A powered vacuum cleaner brush roll as set forth in claim 8, wherein said end cap includes an end portion having a noncircular periphery, and said cup-shaped mounting portion of said thread guard mates with said end portion and also provides a noncircular periphery which is adapted to fit in a bracket in said nozzle and secure said thread guard and shaft against rotation.

10. A powered vacuum cleaner brush roll as set forth in claim 9, wherein and adjusting bolt secures said thread guard and end cap on the and of said shaft and is adjustable to adjust the position of said brush roll in said nozzle.

11. A powered vacuum cleaner brush roll as set forth in claim 8, wherein said thread guard is molded and formed of a single piece of polypropylene.

12. A method of producing brush rolls for vacuum cleaners comprising journaling a brush roll on a shaft with bearings at each end of said brush roll, mounting a thermoplastic thread guard at one end of said brush roll fixed against rotation with said brush roll and providing a skirt fitting around said end portion with frictional contact therewith, rotating said brush roll relative to said skirt causing frictional heating of said skirt, thereby producing wear and deformation of said skirt until frictional contact is substantially eliminated providing substantially free relative rotation and insufficient clearance to permit thread and other debris from passing said skirt into the adjacent bearing.

13. A method of producing brush rolls for vacuum cleaners as set forth in claim 12, wherein said brush roll is formed of a nonthermoplastic material which does not wear when said thread guard wears and deforms.

14. A method of producing brush rolls for vacuum cleaners as set forth in claim 13, wherein said brush roll is formed of wood which expands and contracts slightly when environmental humidity changes.

* * * * *

UNITED STATES PATENT AND TRADEMARK OFFICE

CERTIFICATE OF CORRECTION

PATENT NO. : 4,847,944

DATED : July 18, 1989

INVENTOR(S) : John R. Lackner

It is certified that error appears in the above-identified patent and that said Letters Patent is hereby corrected as shown below:

On the cover page, Section [54], the title should read:

--VACUUM CLEANER WITH POWERED BRUSH ROLL--

Column 1, line 1, the title of the invention should read:

--VACUUM CLEANER WITH POWERED BRUSH ROLL--

Column 3, line 61, delete "as" and insert --a--.

Column 4, line 13, delete "457" and insert --57--.

Column 4, line 22, delete "49" and insert --59--.

Column 6, line 51, delete "and" and insert --an--.

Column 6, line 52, delete "and" (second occurrence) and insert --end--.

Signed and Sealed this

Fifteenth Day of May, 1990

*Attest:*

HARRY F. MANBECK, JR.

*Attesting Officer*

*Commissioner of Patents and Trademarks*